US007740208B2

(12) United States Patent
Mugg

(10) Patent No.: US 7,740,208 B2
(45) Date of Patent: Jun. 22, 2010

(54) MOVABLE POINT CROSSING FROG FOR A RAIL TRACK

(75) Inventor: Philippe Mugg, Haguenau (FR)

(73) Assignee: Vossloh Cogifer, Rueil Malmaison (FR)

( * ) Notice: Subject to any disclaimer, the term of this patent is extended or adjusted under 35 U.S.C. 154(b) by 658 days.

(21) Appl. No.: 11/478,643

(22) Filed: Jul. 3, 2006

(65) Prior Publication Data

US 2007/0001060 A1 Jan. 4, 2007

(30) Foreign Application Priority Data

Jul. 4, 2005 (FR) ..... 05 07091

(51) Int. Cl.
*E01B 7/02* (2006.01)
*E01B 7/00* (2006.01)

(52) U.S. Cl. ..... 246/435 R; 246/460

(58) Field of Classification Search ..... 246/382, 246/384, 392, 454, 458, 468
See application file for complete search history.

(56) References Cited

U.S. PATENT DOCUMENTS 4,982,919 A * 1/1991 Durchschlag et al. ..... 246/382
5,456,430 A * 10/1995 Ortiz-Rivas ..... 246/468
5,560,571 A * 10/1996 Remington ..... 246/468
5,743,496 A * 4/1998 Atkinson, Jr. ..... 246/463
6,732,980 B2 * 5/2004 Hein ..... 246/455

FOREIGN PATENT DOCUMENTS

| | | |
|---|---|---|
| DE | 12 22 957 | 8/1966 |
| DE | 16 58 316 | 8/1970 |
| EP | 0 587 517 | 3/1994 |
| EP | 1 020 562 | 7/2000 |

* cited by examiner

*Primary Examiner*—S. Joseph Morano
*Assistant Examiner*—Robert J McCarry, Jr.
(74) *Attorney, Agent, or Firm*—Young & Thompson

(57) ABSTRACT

A crossing frog includes: a cradle assembly which includes a movable point fitting component which has two projection elements which are mutually spaced-apart, a movable point which is mounted in the cradle assembly and fitted in the fitting component, spacer components which are interposed between the projection elements and the movable point, and accommodation for removably fixing the movable point in the fitting component. The spacer components are fixed to the projection elements in a removable manner by the accommodation for removable fixing so that it is possible to remove the point in a vertical direction relative to the cradle assembly.

12 Claims, 3 Drawing Sheets

MOVABLE POINT CROSSING FROG FOR A RAIL TRACK

FIELD OF INVENTION

The present invention relates to a movable point crossing frog for a rail track, comprising:

a cradle assembly which comprises a movable point fitting component which has two projection elements which are mutually spaced-apart, a movable point which is mounted in the cradle assembly and fitted in the fitting component, spacer components which are interposed between the projection elements and the movable point, and means for removably fixing the movable point in the fitting component.

BACKGROUND

Generally, the design of known crossing frogs does not allow the movable point to be removed and replaced on the track (in situ) when it is worn or damaged.

For example, the crossing frogs described in patent FR 2 788 535 comprise spacers which are formed in one piece with the projection elements. Removing the movable point from the fish-plate chamber can thus be carried out, for crossing frogs of this type, only in the main direction of the track, that is to say, axially. This removal requires the fitting component to be removed beforehand, fixedly joined to the movable point, the removal of the movable point then being carried in the workshop and not in situ, which requires the worn or damaged frog to be removed and replaced with a replacement part of the same type.

A maintenance operation of this type not only involves very high cost, but also the track being closed for a very long period of time.

The object of the invention is to overcome this disadvantage and to make it possible to carry out a maintenance operation of this type in situ in order to very significantly reduce the duration and the cost of the maintenance operation.

SUMMARY OF INVENTION

To this end, the invention relates to a crossing frog of the above-mentioned type, in which the spacer components are fixed to the projection elements in a removable manner by the means for removable fixing, so that it is possible to vertically remove the point relative to the cradle assembly.

According to optional features of the invention:

the means for removable fixing comprise assembly elements which each have a threaded transverse shank which is fastened to the two projection elements and which, in cross-section, extends through the projection elements, the spacers and the movable point;

the assembly elements each have a bush assembly in which the threaded shank is mounted, the bush assembly extending at least partially, in cross-section, through the projection elements, the spacers and the movable point;

the crossing frog comprises, for each spacer component, at least one security shim which is fixed to a projection element in a removable manner, for example, by means of screwing, in abutment against an upper face of the spacer component so as to limit the vertical displacement of the point;

the cradle assembly comprises a cradle at the side of the point end, the fitting component at the side of the projection end, and two intermediate elements which connect the cradle to the two projection elements, respectively, and the fitting component has a support plate which extends between the two projection elements and which supports the movable point.

According to a first embodiment of the invention:

the support plate is produced in one piece with the two projection elements;

the fitting component is constituted by a unitary projection component, in particular cast from steel or special cast iron; and the projection component is assembled on the two intermediate elements by means of welding or by means of adhesively-bonded joints.

According to a second embodiment of the invention:

the support plate is a separate component from the two projection elements; and the two projection elements are produced by processing the two intermediate elements.

BRIEF DESCRIPTION OF DRAWINGS

Embodiments of the invention will be described in greater detail below with reference to the appended drawings, in which:

FIG. 1 schematically illustrates a crossing frog 1 according to the invention, positioned on a track, in a state for use.

DETAILED DESCRIPTION OF PREFERRED EMBODIMENTS

In the remainder of the description below, the crossing frog will be assumed to be in its horizontal position for use and all the terms relating to directions and positions should be understood in accordance with this orientation.

In particular, the terms "horizontal" and "vertical", which may qualify specific components of the crossing frog, should be understood in accordance with a horizontal position for use of the crossing frog.

Furthermore, the terms "axial" and "transverse" should be understood relative to the general direction of the track.

Figure 1:
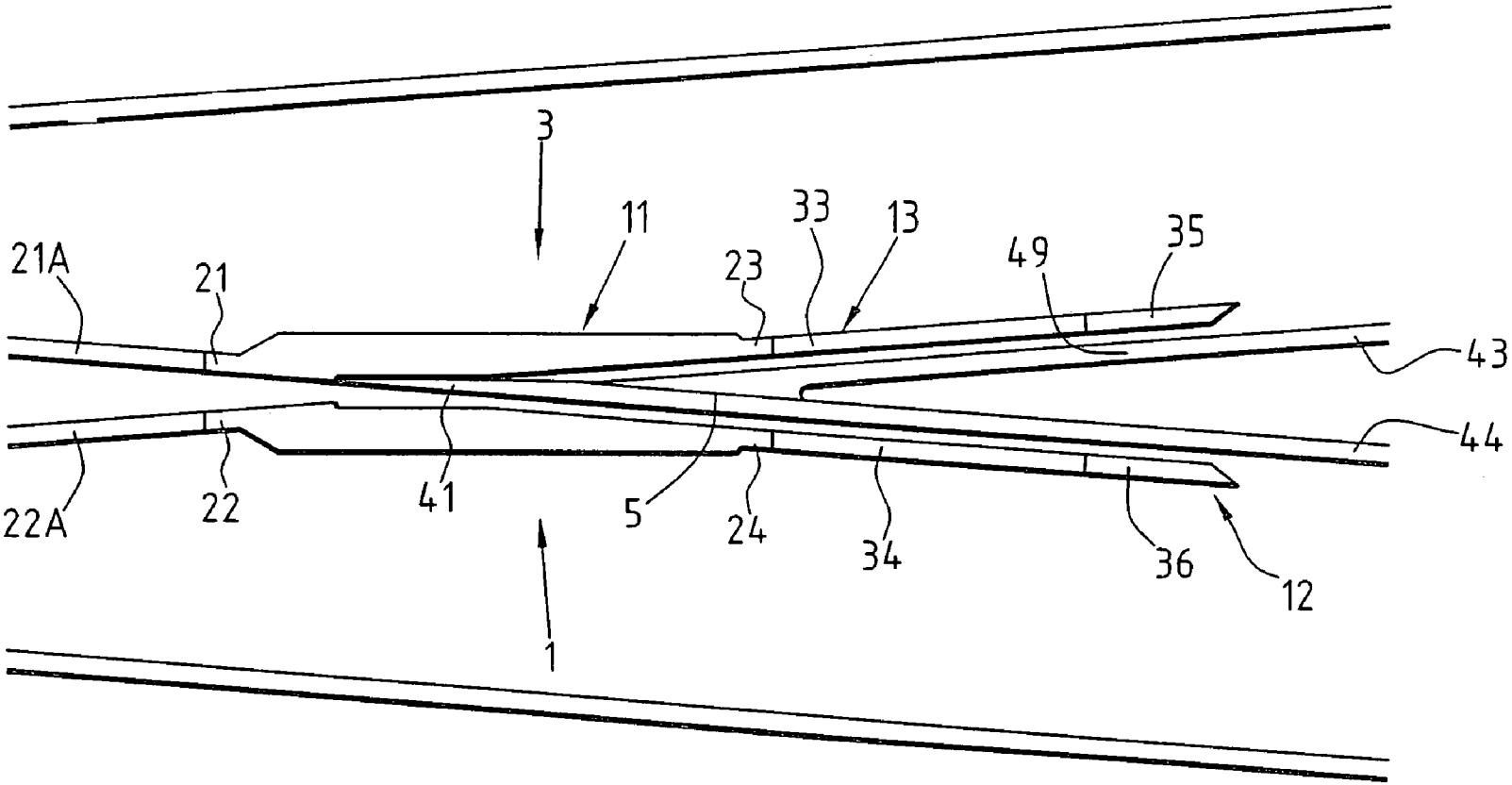
FIG. 1 is a schematic plan view of a crossing frog according to the invention, positioned on a track.

With reference to the schematic view of FIG. 1, the crossing frog 1 substantially comprises a cradle assembly 3 which is fixed to the cross-pieces, and a movable point 5 which is mounted in the cradle assembly 3.

The cradle assembly 3 is substantially constituted by a point cradle 11, a fitting component 12, and an intermediate component 13 which connects the fitting component 12 to the point cradle 11.

At one point end, the cradle 11 has two regions 21, 22 which are arranged symmetrically at one side and the other of the vertical axial plane.

These regions 21, 22 have, in cross-section, respective forms which are symmetrical relative to the vertical axial plane of the cradle 11 and have a rail-like profile.

Two lengths 21A, 22A of rail are welded to the regions 21, 22 of the point end of the cradle 11, respectively, each of these lengths having a rail-like profile identical to that of the corresponding end region 21, 22.

In the same manner, the cradle 11 has, at the projection end thereof, two regions 23, 24 which are arranged symmetrically at one side and the other of the vertical axial plane, these regions 23, 24 having, in cross-section, respective forms which are symmetrical relative to this plane.

The intermediate portion 13 comprises two intermediate elements 33, 34 which each have a rolled rail-like profile or cast elements whose ends are identical to those of the corresponding region 23, 24.

The fitting component 12 correspondingly comprises two projection elements 35, 36 whose profile ends correspond to those of the intermediate elements 33, 34 and extend the intermediate elements 33, 34, respectively.

The cradle assembly 3 further comprises, generally as a plurality of assembled components, a base wall which extends horizontally between the profiles defined by the end regions 21, 22, 23, 24, the intermediate elements 33, 34 and the projection elements 35, 36. The movable point 5 rests on this base wall when it is mounted in the cradle assembly 3.

The movable point 5 comprises a tapered free end region 41 (or point end) having a profile which is provided in order to ensure continuity of the guiding surface, selectively with one or other of the point regions 21, 22 of the cradle 11, in accordance with the position of the point end 41.

Figure 3:
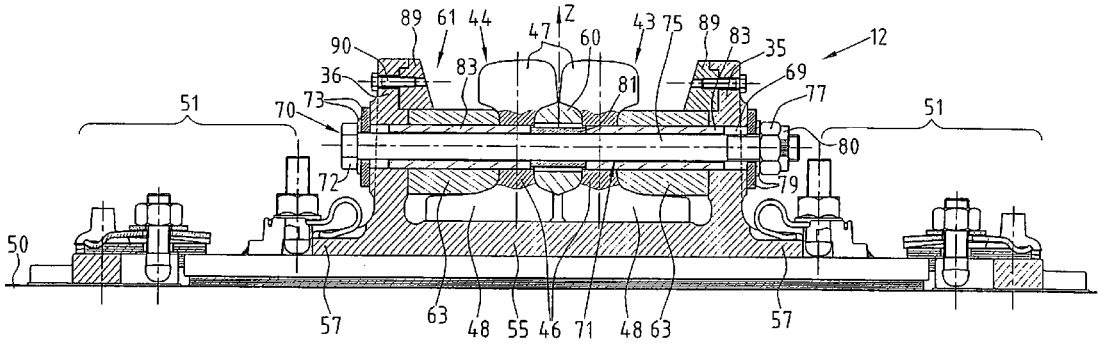
FIG. 3 is an enlarged section, taken in plane 3-3, of the crossing frog of FIG. 2.
Figure 5:
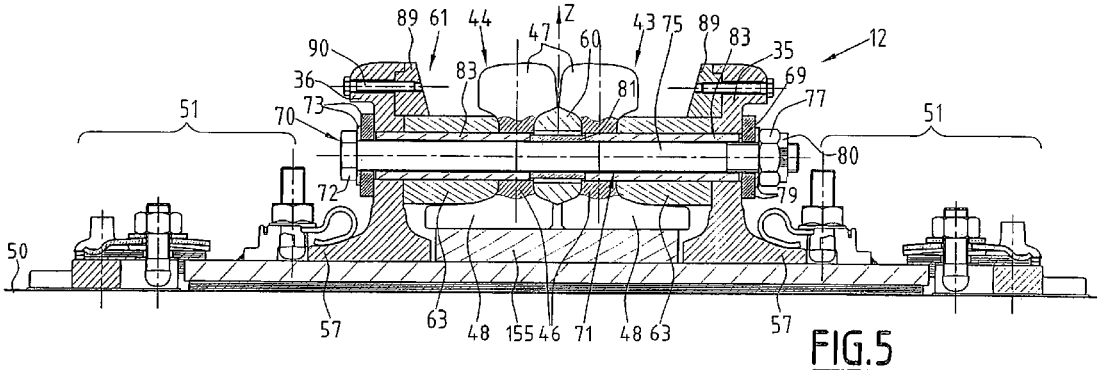
FIG. 5 is an enlarged section, taken in plane 5-5, of the crossing frog of FIG. 4.

As will also be seen more clearly with reference to FIGS. 3 and 5, the movable point 5 comprises two rails 43, 44 having a special profile having a thick web 46 which has a mushroom-like member 47 and a reinforced runner 48. These rails 43, 44 extend so as to converge towards the point end 41, this being constituted at the end of one of the two rails.

The movable point 5 has a fitting section 49 which is fixed in the cradle assembly 3 by means which will be described below.

Figure 2:
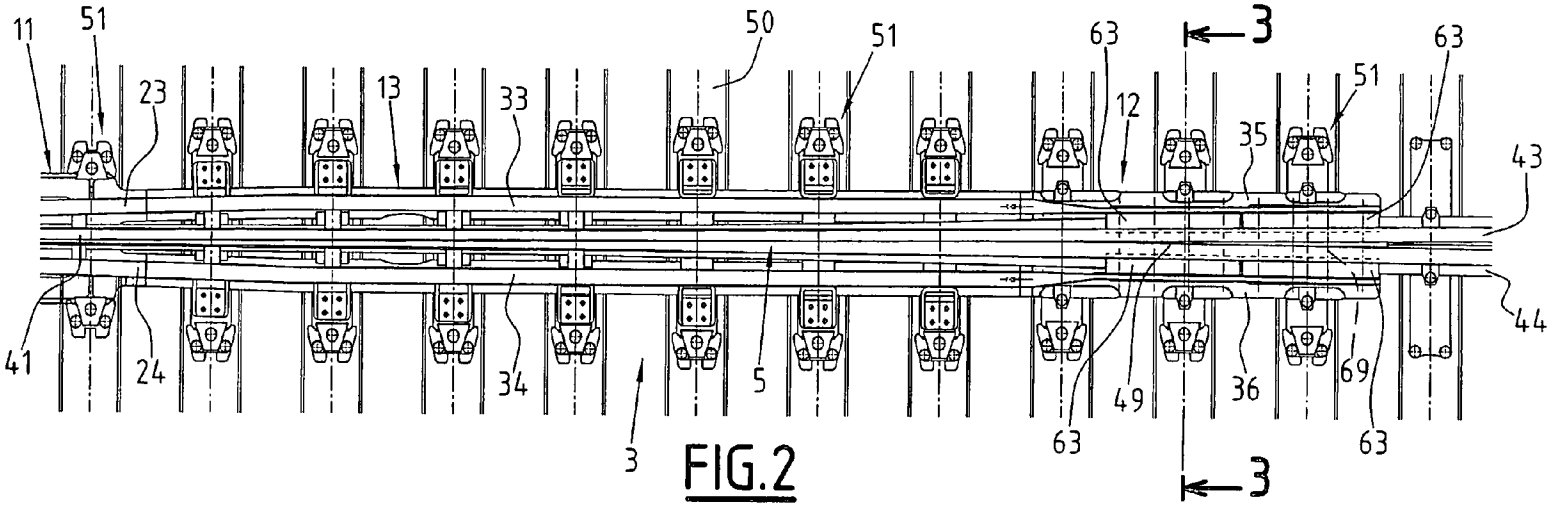
FIG. 2 is a partial plan view of a crossing frog according to a first embodiment of the invention.

FIGS. 2 and 3 illustrate a first embodiment of the invention, in which the fitting component 12 is constituted by a unitary cradle. For example, this unitary cradle 12 is produced by means of casting from steel or special cast iron, and the projection elements 35, 36 thereof are assembled with the respective intermediate elements 33, 34 by means of welding or by means of adhesively-bonded joints.

As illustrated in FIG. 2, the cradle assembly 3 is fixed to cross-pieces 50 by means of fixing devices which are all generally designated 51 but which may be of a different type for each of the elements of the cradle assembly 3, that is to say the cradle 11, the fitting component 12, and the intermediate component 13. The invention does not relate to these fixing devices and they are therefore not described in greater detail.

As can be seen in FIG. 3, the unitary cradle 12 which forms a fitting component has a support plate 55 which forms a base wall, on which the runners 48 of the two rails 43, 44 which form the movable point rest.

The support plate 55 which is formed in one piece with the projection elements 35, 36 defines, with the projection elements 35, 36, a generally U-shaped cross-section of the cradle 12. The support plate 55 is extended laterally, externally relative to the projection elements 35, 36, by means of outer rims 57 which allow it to be fixed to the cross-pieces 50 of the cradle 12 using the fixing devices 51.

The two rails 43, 44 are mutually secured by means of a spacer 60 which conforms to the inner profile portions thereof and is supported thereon.

In order to ensure the fixing and securing of the movable point 5 in the region of the section 49 thereof in the cradle 12 (or fitting component), the crossing frog 1 comprises removable fixing and securing means 61.

These means 61 comprise spacer components 63, of which there are four in the example illustrated in FIG. 2 and which are arranged in pairs facing each other each side of the movable point.

Each spacer component 63 has a generally parallelpipedal form which is axially elongate. The two spacer components 63 of the same pair are substantially symmetrical relative to the vertical axial plane and each secure one of the two rails 43, 44 on the corresponding projection element 35, 36.

Each spacer component 63 is supported, by means of an outer lateral face, on an inner face of the corresponding projection element 35, 36 and, by means of an inner lateral face, on an outer side of the web 46 of the corresponding rail 43, 44.

The spacers 63 have a shape which is suitable for cooperating, by means of complementary shape over the entire axial length of the spacer, with a portion of the outer profile of the respective rail 43, 44, this portion comprising the upper surface of the runner 48, the outer surface of the web 46, as far as the transition surface between the web 46 and the mushroom-like member 47.

Transverse holes 69, for example, four per spacer, extend coaxially through the projection elements 35, 36, the webs 46 of the rails 43, 44, the spacer 60 and the spacer components 63. These holes 69 are offset axially relative to each other in the example illustrated; they are illustrated by means of dot-dash lines in FIG. 2.

The fixing and securing means 61 comprise, for each hole 69, a fastening bolt 70.

The bolt 70 comprises a screw 71 whose head 72 is supported on an outer face of a projection element 36, by means of washers 73, and whose threaded shank 75 extends coaxially through the hole 69. The bolt 70 further comprises a nut 77 which is fastened to the threaded end of the threaded shank 75 and which is supported on an outer face of the other projection element 35 by means of washers 79. The fastening of the nut 77 on the screw 71 is secured by means of a brake nut 80.

The fixing and securing means 61 further comprise a bush assembly which is arranged coaxially between the threaded shank 75 and the inner face of the hole 69. This bush assembly comprises a central cylindrical sleeve 81 which is arranged in the hole of the spacer 60, and two pins 83 (preferably of the Mecanindus® type). These pins 83 are each engaged in a section of the hole 69 formed in a projection element 35, 36, a spacer component 61, and a rail web 46, at one side and the other of the central sleeve 81.

Each bolt 70 defines, with the bush assembly 81, 83, a removable assembly element which, when used, is fastened to the two projection elements 35, 36 by securing, in a transverse manner with no possibility of significant transverse play, the movable point 5 between the projection elements 35, 36 by means of the spacer components 63.

The fixing and securing means 61 comprise, in the example illustrated, although this is optional, security shims 89 which are associated with each spacer component 63. Each shim 89 is fixed in a removable manner, in this instance by means of screws 90, to a respective projection element 35, 36, in an upper portion of the projection element. The shim 89 protrudes towards the inner side of the cradle 12 and is supported, by means of a lower face, on an upper face of the corresponding spacer component 63.

The shims 89 are provided in order to limit the vertical displacement of the spacer components 63 during actual use of the crossing frog, so as to reduce the vertical movements of the point 5 if one or more bolts 70 become(s) loose.

It should be understood that the movable point 5 may be removed vertically (in direction Z indicated in FIG. 3) from the fitting position thereof, after removing the fixing and securing means 61.

In order to remove the movable point 5 from the cradle assembly 3, operators may proceed in situ in the following manner:

releasing the ends of the rails 43, 44 by separating them from the conventional track;

removing the shims 89 by removing the screws 90;

removing the bolts 70 with their bush assembly 81, 83 (using appropriate means, such as hydraulic jacks);

vertically removing, in direction Z, the movable point 5 with the spacer components 63.

After replacing the damaged movable point, the movable point is reassembled in reverse order which it is not necessary to set out in detail.

Figure 4:
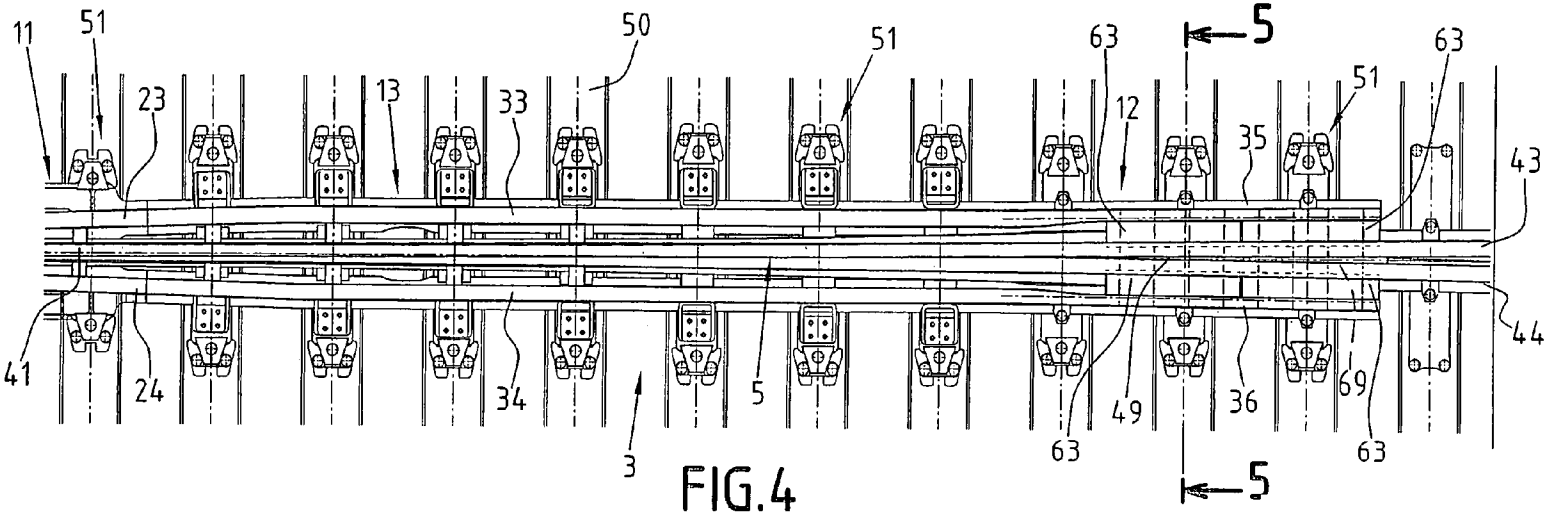
FIG. 4 is a view similar to FIG. 2 of a crossing frog according to a second embodiment of the invention.

The second embodiment of the invention illustrated in FIGS. 4 and 5 differs from the first embodiment described above only in that the fitting component 12 is not defined by a unitary cradle.

In this embodiment, the support plate 155 is a separate component from the two projection elements 35, 36 which are obtained by processing the respective intermediate elements 33, 34. The support plate 155 is preferably produced from a different material from that of the projection elements 35, 36 and is fixed to the support independently thereof.

It should be noted in particular that the spacer components 63 and the means 61 for fixing and securing the movable point in the fitting component 12 are, in all respects, similar or identical to those described in the first embodiment. They will therefore not be described again.

It should be noted that the cradle 11 is preferably produced by means of casting techniques and cast from alloyed steel, in particular from cast manganese steel which is hyper-quenched and, optionally, pre-hardened. It is processed over all the rolling, contact, sliding or connection surfaces.

The two rail lengths 21A, 22A which form part of the crossing frog are rail profiles of rolled carbon steel or lightly alloyed steel and are connected to the cradle 11 by means of welding, optionally using inserts.

The intermediate elements 33, 34 are preferably produced in the form of a rail or from cast carbon steel or lightly alloyed steel which has a mechanical strength similar to that of the rails, and which allows them to be welded to the cradle 11, optionally using an insert.

The invention claimed is:

1. A movable point crossing frog for a rail track, comprising:

a cradle assembly which comprises a movable point fitting component which has two projection elements which are mutually spaced-apart, a movable point which is mounted in the cradle assembly between the two projection elements and is fitted in the fitting component, spacer components which are interposed between the projection elements and the movable point, and means for removably fixing the movable point to the fitting component, the spacer components are fixed to the projection elements in a removable manner by the means for removable fixing so that the movable point and the spacer components are simultaneously removable in a vertical direction relative to the cradle assembly.

2. The crossing frog according to claim 1, wherein the means for removable fixing comprise assembly elements which each have a threaded transverse shank which is fastened to the two projection elements and which, in cross-section, extends through the projection elements, the spacers and the movable point.

3. The crossing frog according to claim 2, wherein the assembly elements each have a bush assembly in which the threaded shank is mounted, the bush assembly extending at least partially, in cross-section, through the projection elements, the spacers and the movable point.

4. The crossing frog according to claim 1, further comprising, for each spacer component, at least one security shim which is fixed to a corresponding one of the projection elements in a removable manner in abutment against an upper face of the spacer component so as to limit the vertical displacement of the point.

5. The crossing frog according to claim 1, wherein the cradle assembly comprises a cradle at the side of the point end, the fitting component at the side of the projection end, and two intermediate elements which connect the cradle to the two projection elements, respectively.

6. The crossing frog according to claim 1, wherein the fitting component has a support plate which extends between the two projection elements and which supports the movable point.

7. The crossing frog according to claim 5 wherein the fitting component has a support plate which extends between the two projection elements and which supports the movable point; and wherein the support plate is produced in one piece with the two projection elements.

8. The crossing frog according to claim 7, wherein the fitting component is constituted by a unitary projection component.

9. The crossing frog according to claim 8, wherein the projection component is assembled on the two intermediate elements by means of welding or by means of adhesively-bonded joints.

10. The crossing frog according to claim 5 wherein the fitting component has a support plate which extends between the two projection elements and which supports the movable point; and wherein the support plate is a separate component from the two projection elements.

11. The crossing frog according to claim 8, wherein the unitary projection component is cast from steel or special cast iron.

12. The crossing frog according to claim 4, wherein the at least one security shim is screwed to the projection element.

* * * * *